US010690151B2

(12) United States Patent
Hahn et al.

(10) Patent No.: US 10,690,151 B2
(45) **Date of Patent: *Jun. 23, 2020**

(54) DEVICE FOR RECOVERING HYDRAULIC ENERGY BY CONNECTING TWO DIFFERENTIAL CYLINDERS

(71) Applicant: Liebherr-Mining Equipment Colmar SAS, Colmar (FR)

(72) Inventors: Philipp Hahn, Turckheim (FR); Volker Gliniorz, Breisach am Rhein (DE); Guillaume Bonnetot, Zimmersheim (FR)

(73) Assignee: LIEBHERR-MINING EQUIPMENT COLMAR SAS, Colmar (FR)

( * ) Notice: Subject to any disclaimer, the term of this patent is extended or adjusted under 35 U.S.C. 154(b) by 0 days.

This patent is subject to a terminal disclaimer.

(21) Appl. No.: 15/622,663

(22) Filed: Jun. 14, 2017

(65) Prior Publication Data

US 2017/0363112 A1 Dec. 21, 2017

(30) Foreign Application Priority Data

Jun. 15, 2016 (DE) ..... 10 2016 007 267

(51) Int. Cl.
*F15B 1/02* (2006.01)
*F15B 21/14* (2006.01)
(Continued)

(52) U.S. Cl.
CPC ..... *F15B 1/024* (2013.01); *B66C 13/20* (2013.01); *E02F 9/2217* (2013.01); *E02F 9/2296* (2013.01); *F15B 1/033* (2013.01); *F15B 1/04* (2013.01); *F15B 1/26* (2013.01); *F15B 11/16* (2013.01); *F15B 13/0401* (2013.01); *F15B 15/18* (2013.01); *F15B 20/00* (2013.01); *F15B 21/14* (2013.01); *B66C 13/00* (2013.01); *F15B 2201/411* (2013.01); *F15B 2211/20546* (2013.01); *F15B 2211/212* (2013.01);
(Continued)

(58) Field of Classification Search
CPC ..... F15B 2211/20546; F15B 2211/88; F15B 1/024; F15B 21/14; F15B 1/033; F15B 11/16; F15B 1/04; E02F 9/2217; B66F 9/22; B66C 13/20
See application file for complete search history.

(56) References Cited

U.S. PATENT DOCUMENTS

2013/0318955 A1* 12/2013 Zhang ..... E02F 9/2217 60/413

FOREIGN PATENT DOCUMENTS

DE 112013002784 T5 3/2015

* cited by examiner

*Primary Examiner* — Abiy Teka
(74) *Attorney, Agent, or Firm* — McCoy Russell LLP

(57) ABSTRACT

Device for recovering hydraulic energy in a machine comprising at least a first differential cylinder-piston assembly having a differential cylinder with a separate rod and base side, at least a second differential cylinder-piston assembly having a differential cylinder with a separate rod and base side, and at least one hydraulic accumulator that can be hydraulically connected to at least one of the differential cylinder-piston assemblies, wherein the differential cylinder-piston assemblies are mechanically coupled to one another, and wherein the potential energy of at least one of the differential cylinder-piston assemblies retracting under a compressive load can at least partially be stored in the hydraulic accumulator.

16 Claims, 1 Drawing Sheet

(51) Int. Cl.

| | |
|---|---|
| ***F15B 1/033*** | (2006.01) |
| ***E02F 9/22*** | (2006.01) |
| ***B66C 13/20*** | (2006.01) |
| ***F15B 1/04*** | (2006.01) |
| ***F15B 1/26*** | (2006.01) |
| ***F15B 11/16*** | (2006.01) |
| ***F15B 13/04*** | (2006.01) |
| ***F15B 15/18*** | (2006.01) |
| ***F15B 20/00*** | (2006.01) |
| *B66C 13/00* | (2006.01) |

(52) U.S. Cl.

CPC ..... *F15B 2211/31541* (2013.01); *F15B 2211/31588* (2013.01); *F15B 2211/40* (2013.01); *F15B 2211/41581* (2013.01); *F15B 2211/46* (2013.01); *F15B 2211/50545* (2013.01); *F15B 2211/5159* (2013.01); *F15B 2211/7107* (2013.01); *F15B 2211/761* (2013.01); *F15B 2211/88* (2013.01)

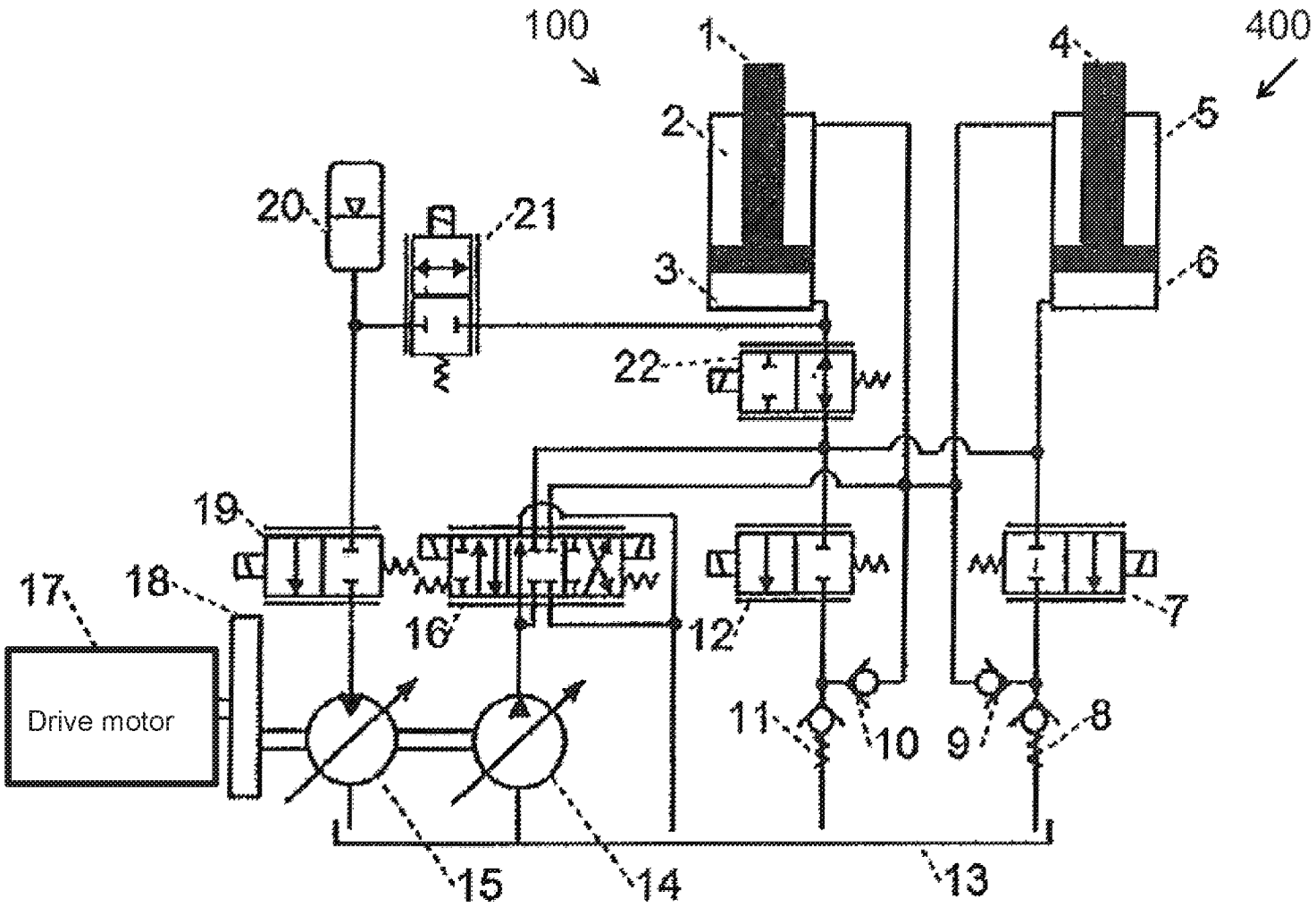
400
100
1
2
3
4
5
6
7
8
9
10
11
12
13
14
15
16
17
18
19
20
21
22
Drive motor

DEVICE FOR RECOVERING HYDRAULIC ENERGY BY CONNECTING TWO DIFFERENTIAL CYLINDERS

CROSS-REFERENCE TO RELATED APPLICATION

The present application claims priority to German Patent Application No. 10 2016 007 267.9, entitled "DEVICE FOR RECOVERING HYDRAULIC ENERGY BY CONNECTING TWO DIFFERENTIAL CYLINDERS," filed on Jun. 15, 2016, the entire contents of which is hereby incorporated by reference in its entirety for all purposes.

TECHNICAL FIELD

The invention relates to a device for recovering hydraulic energy in a machine comprising at least a first differential cylinder-piston assembly having a differential cylinder with a separate rod and base side, at least a second differential cylinder-piston assembly having a differential cylinder with a separate rod and base side, and at least one hydraulic accumulator that can be hydraulically connected to at least one of the differential cylinder-piston assemblies, wherein the differential cylinder-piston assemblies are mechanically coupled to one another, and wherein the potential energy of at least one of the differential cylinder-piston assemblies retracting under a compressive load can at least partially be stored in the hydraulic accumulator.

BACKGROUND AND SUMMARY

In the hydraulic cylinder circuits for mobile machines known from the prior art, the retraction of hydraulic cylinders under a compressive load, e.g. by pressure-free lowering of the lifting arm, is implemented by means of a throttle control. In doing so, the potential energy associated with the load on the cylinder is converted into heat as a result of the restriction of the pressurised volume flow. This process leads to a disadvantageous destruction of the potential energy present. Furthermore, this conversion into heat also necessitates the disadvantageous application of additional cooling power within the machine.

A common embodiment of the hydraulic cylinders or hydraulic cylinder-piston devices in mobile machines is the differential cylinder. Where the term cylinder is used herein, this can, depending on the context, also be interpreted by a person skilled in the art as a complete cylinder-piston assembly.

When a differential cylinder of this kind is retracted with the help of a throttle control and compressive load, it must be ensured that a refilling of the rod side cylinder chamber is guaranteed. This can be achieved, on the one hand, by the delivery of a corresponding supply flow volume through the operating pumps or, alternatively, the necessary refilling of the rod side cylinder chambers can be carried out by returning the restricted volume flow. The return of the restricted volume flow results in a division of the volume flow exiting the base side of the differential cylinder according to the ratio of the areas of the rod side and base side of the hydraulic cylinder, whereby one portion of the volume flow is directed into the rod side chambers of the cylinder, and the other portion into the tank.

If it is desired to store the potential energy associated with the process of lowering the lifting cylinder, the objective would be to store the largest possible portion of the available energy. In the field of hydraulics, this would mean the largest possible oil quantity under the highest possible pressure. The hydraulic circuits known from the prior art in which the return of a portion of the base side volume flow into the rod side chambers of the hydraulic cylinder has been implemented reduce the volume flow that is available for storage.

Different solutions exist at present for storing the potential energy when lowering the boom of mobile hydraulic machines. Solutions are known from the prior art in which one of the two cylinders is used to store energy. These solutions use a positive displacement machine in a closed circuit to refill the rod side chambers of both cylinders with the return flow from the second cylinder. One disadvantage of such devices is the lack of exchange of oil on the base side of the hydraulic cylinder that is connected to the accumulator. The oil volume is only moved between the hydraulic accumulator and base side of the cylinder.

In other known devices, a hydraulic pump is used to guarantee refilling of the rod side chambers when retracting the cylinders. Refilling by applying hydraulic power in this manner does not constitute an energy efficient means of controlling the hydraulic consumer.

A method of taking up the potential energy of the boom by means of a gas filled cylinder is also known. Such devices require a gas cylinder to also be integrated into the machine, which means higher integration costs. Furthermore, the storage volume of the gas storage cylinder must be designed to accommodate the entire travel of the drive, even if the entire travel is not used during normal working operation.

Various devices are currently known for transferring the stored hydraulic energy, for example direct transfer of the stored energy to the fan circuit of the respective machine. Depending on the operating point of the fan circuit, it may be necessary to restrict the volume flow supply from the hydraulic accumulator to the fan circuit. This leads to throttling losses and consequently to a disadvantageous reduction in the quantity of reusable hydraulic energy.

Furthermore, a method of using the stored hydraulic energy to directly supply the operating pumps is known. This requires a switching means to connect the suction side of the operating pump either with the hydraulic tank or the hydraulic accumulator. When the pump is not supplied from the hydraulic accumulator, the valve causes pressure losses that can affect the suction pressure of the pump and thereby lead to unfavourable operating conditions. Moreover, it is necessary to provide cooling and filtering means between the hydraulic accumulator and the intake of the operating pump.

Also known from the prior art are devices in which the hydraulic energy derived from the potential energy of the working equipment or relevant cylinder can be distributed between two parallel paths. Firstly the energy can be transferred directly back into the drivetrain via a recovery motor, and secondly the energy can be directed to a hydraulic accumulator.

The circuits known from the prior art therefore exhibit three disadvantages:

The potential energy of the lifting/lowering process is destroyed by the action of restricting the flow and cannot be used for other processes.

The potential energy of the lifting/lowering process is put into the hydraulic system in the form of heat energy and must then be directed away again by means of suitable cooling devices. These processes are also energy consuming.

The splitting of the base side volume flow when the lifting cylinder is lowered leads to a reduction in the potential amount of storable energy.

Therefore it is the objective of the present invention to store the potential energy associated with the compressive load on the hydraulic cylinder while at the same time being able to provide the necessary oil quantity to refill the rod side chambers of the hydraulic cylinders.

This object is achieved by means of a device for recovering hydraulic energy in a machine having the characteristics of claim 1. Advantageous further developments are described in the subclaims. The present invention provides for a device comprising at least a first differential cylinder-piston assembly having a differential cylinder with a separate rod and base side, at least a second differential cylinder-piston assembly having a differential cylinder with a separate rod and base side, and at least one hydraulic accumulator that can be hydraulically connected to at least one of the differential cylinder-piston assemblies, wherein the differential cylinder-piston assemblies are mechanically coupled to one another, and wherein the potential energy of at least one or exactly one of the differential cylinder-piston assemblies retracting under a compressive load can at least partially be stored in the hydraulic accumulator.

Advantageously according to the invention, it is possible to maximise the quantity of storable potential energy that can be used for other tasks within the machine. Furthermore, the cooling power employed can be reduced since the cooling system within the machine has less dissipated heat to remove. As a result, the overall operation of the hydraulic machine can be more energy efficient.

Due to the coupling of at least two differential cylinder-piston assemblies, it is possible to store in the hydraulic accumulator the potential energy from one of the differential cylinder-piston assemblies when both differential cylinder-piston assemblies are retracted at the same time.

In a preferred embodiment, it is conceivable that the hydraulic accumulator can be hydraulically connected to more than one of the differential cylinder-piston assemblies. Accordingly, energy can be directed out of the hydraulic accumulator and into the respective differential cylinder-piston assemblies in the form of a pressurised hydraulic fluid.

In a further preferred embodiment, it is conceivable that an assisting motor is provided that is designed to direct into a drivetrain of the machine, and thereby recover, the hydraulic energy stored in the hydraulic accumulator, wherein the assisting motor can be hydraulically connected to the hydraulic accumulator in particular via a valve of the assisting motor. In a further preferred embodiment, it also conceivable that the device is designed to recover the energy stored in the hydraulic accumulator by transferring the energy to at least one of the differential cylinder-piston assemblies. This allows, advantageously, at least two types of energy recovery to be carried out, namely directly by returning the hydraulic fluid from the hydraulic accumulator to at least one differential cylinder-piston assembly, and alternatively or in addition to this via the assisting motor. The hydraulic energy directed from the hydraulic accumulator to the assisting motor can in this case be used, for example, to assist a primary drive motor of the machine.

In a further preferred embodiment, it is conceivable that in order to recover the hydraulic energy stored in the hydraulic accumulator, the hydraulic energy can be transferred either simultaneously, alternately or sequentially to the drivetrain and/or to at least one of the differential cylinder-piston assemblies. The transfer of energy in this case can, of course, occur by means of the transfer of a pressurised hydraulic fluid. This allows, advantageously, the energy stored in the hydraulic accumulator to be employed, depending on the current operating state of the machine, in the particular areas of the machine currently having the largest energy requirements, or where the recovery of the energy would have the greatest energy saving potential.

In a further preferred embodiment, it is conceivable that the differential cylinder-piston assemblies are arranged to operate in parallel. This enables two or more differential cylinder-piston assemblies to be provided, for example to pivot a joint of the machine.

In a further preferred embodiment, it is conceivable that at least one operating pump for driving the differential cylinder-piston assembly, and/or at least one slide valve for controlling the hydraulic accumulator and/or the differential cylinder-piston assembly, and/or at least one tank, and/or at least one hydraulic accumulator valve for shutting off the hydraulic accumulator is provided, and/or that each of the differential cylinder-piston assemblies is associated with at least one brake valve. The advantages of the individual components are evident from the description of the FIGURE.

In a further preferred embodiment, it is conceivable that a shut-off valve for isolating at least one of the differential cylinder-piston assemblies from the tank and from the operating pump is provided.

The present invention further relates to a machine, in particular a wheel loader, a hydraulic excavator or a crane having a device for recovering hydraulic energy in accordance with one of the claims 1 to 8, and in which, in a preferred embodiment, the machine is designed in such a manner as to be still operable without the loss of other functions in the event of a breakdown of the device for recovering hydraulic energy. The machine can be designed in such as way that the device for recovering hydraulic energy is arranged redundantly to the actuators provided on the machine.

BRIEF DESCRIPTION OF THE FIGURE

FIG. 1 shows an embodiment of a machine comprising at least a first differential cylinder-piston assembly having two differential cylinders.

DETAILED DESCRIPTION

As can be seen in FIG. 1, a suitable precharging pressure can be applied to the high-pressure accumulator 20 when a machine or work machine with the inventive device is put into operation. To start the storage process, an external force must be applied to the differential cylinder 1 and the differential cylinder 4 thereby retracting the differential cylinders 1, 4. This causes pressures to build up on the base side 3 of the differential cylinder 1 and the base side 6 of the differential cylinder 4 which governs the amount of potential energy present. This potential energy can be taken up by means of the hydraulic accumulator 20.

To start the lowering process, the brake valve 7 of the differential cylinder 4 and the hydraulic accumulator valve 21 are opened. The volume flow moves out of the base side 6 of the differential cylinder 4, through the brake valve 7 of the differential cylinder 4 and the non-return valve 9, and into the rod side 5 of the differential cylinder 4 and the rod side 2 of the differential cylinder 1. The term differential cylinder-piston assembly 100, 400 encompasses, in this case, each differential cylinder 1, 4 and the corresponding separate rod 2, 5 and base sides 3, 6. The term may also encompass the respective pistons.

Any excess volume flow out of the base side 6 of the differential cylinder 4 can be led off to the tank 13 via the precharging valve 8. The volume flow moves out of the base 3 of the differential cylinder 1 and into the hydraulic accumulator 20 via the hydraulic accumulator valve 21. As a result of the take-up of the volume flow in the hydraulic accumulator 20 from the base side 3 of the differential cylinder 1, the pressure in the hydraulic accumulator 20 increases. The speed of retraction of the drive, consisting of the differential cylinder 1 and differential cylinder 4 or the respective differential cylinder-piston assemblies 100, 400, can be adjusted by proportional control of the hydraulic accumulator valve 21.

To stop the retracting movement of the differential cylinder 1 and differential cylinder 4, the brake valve 7 of the differential cylinder 4 and the hydraulic accumulator valve 21 are closed. The hydraulic accumulator 20 now contains the pressurised oil volume that was displaced out of the base side 3 of the differential cylinder 1 during the retracting movement of the linear drive. To reuse the hydraulic energy in the hydraulic accumulator 20 for an extension movement of the linear drive, the shut-off valve 22 is closed. Depending on the position of the slide valve 16, the base side 6 of the differential cylinder 4 is supplied with a volume flow from the operating pump 14. The operating pump is driven by the drive motor 17 via the transfer gearbox 18. To supply the hydraulic energy in the hydraulic accumulator 20 to the base side 3 of the differential cylinder 1, the hydraulic accumulator valve 21 is opened. The pressurised volume flow thereby moves out of the hydraulic accumulator 20 and into the base side 3 of the differential cylinder 1 via the hydraulic accumulator valve 21. When the discharge process for the hydraulic accumulator 20 has ended, the hydraulic accumulator valve 21 is closed and the shut-off valve 22 opened. Volume flow from the operating pump 14 now also moves into the base side 3 of the differential cylinder 1 via the slide valve 16 and the linear drive extends again. The volume flow exiting from the rod side 2 of the differential cylinder 1 and the rod side 5 of the differential cylinder 4 during the entire extension movement of the linear drive returns to the tank 13 via the slide valve 16.

Alternately or sequentially to the direct transfer to the linear drive, the energy of the pressurised oil volume in the hydraulic accumulator 20 after the storage process can be transferred again to the drivetrain of the machine. For this purpose, the assisting motor 15 is connected to the hydraulic accumulator 20 via the hydraulic assisting motor valve 19. The assisting motor 15 can be mounted directly on the transfer gearbox 18 of the machine and is driven by means of the fixed or prescribed rotational speed of the drive motor 17. Depending on the displacement of the assisting motor 15 and the particular operating state of the hydraulic accumulator 20, the energy is then transferred to the drivetrain. At the end of the energy transfer process, the assisting motor valve 19 is closed thereby disconnecting the hydraulic accumulator 20 and the assisting motor 15.

Depending on the size of the hydraulic accumulator 20, it is possible to store the potential energy of part of, or the entire stroke of the linear drive.

If the hydraulic accumulator 20 is designed to accommodate only part of the stroke of the differential cylinder 1, and the retracting movement needs to extend further than allowed by the design of the hydraulic accumulator 20, a brake valve circuit can be employed. For this purpose, the hydraulic accumulator valve 21 is closed at the end of the storage process while the brake valve 7 remains open. The brake valve 12 of the differential cylinder 1 is now opened. The volume flow exiting the base side 3 of the differential cylinder 1 flows into the rod side 2 of the differential cylinder 1 and into the rod side 5 of the differential cylinder 4 via the brake valve 12 and via the opened shut-off valve 22 and non-return valve 10. The excess volume flow is led off to the tank 13 via the precharging valve 11.

This control of the brake valve 12 of the differential cylinder 1 and the brake valve 7 of the differential cylinder 4 also occurs whenever it is desired to retract the linear drive when operating without an accumulator system or with a defective accumulator system, whereby accumulator system refers to the hydraulic accumulator 20 and the accumulator valve 21.

To retract the linear drive during the machine cycle, and to direct the volume flow of the operating pump 14 by suitably controlling the slide valve 16 on the rod side 2 of the differential cylinder 1 and the rod side 5 of the differential cylinder 4, the shut-off valve 22 is kept open. This directs the volume flow exiting from the base side 3 of the differential cylinder 1 and the base side 6 of the differential cylinder 4 into the tank 13 via the slide valve 16.

The circuit contains at least one operating pump 14 and at least one slide valve 16. All kinds of hydraulic accumulators 20 employing a variety of energy storage media, for example nitrogen, can be used. Conceivable are embodiments as gas accumulators, piston accumulators, membrane accumulators or spring accumulators as well as different combinations of accumulator embodiments.

The valves shown can be used as single 2/2-way valves or also as multiple valves on a valve rod. Proportional and/or switching control of the individual valves is likewise possible.

The inventive device differs from the prior art in that the potential energy of the equipment can always first be stored in the hydraulic accumulator, and then reused. In this case it is possible to use either a recovery motor, or alternatively or in addition to this the energy can also be transferred directly back into the hydraulic cylinder.

The invention is characterised by an arrangement of at least two hydraulic differential cylinders that are mechanically coupled to each other, whereby the areas of the base and rod side are configured in such a way that the area of one base side is greater than or equal to the area of the two rod sides.

The invention is characterised in that a large part of the potential energy present when a hydraulic linear drive is retracted under a compressive load can be stored with the help of one or more hydraulic accumulators.

The invention is further characterised in that only one of the two differential cylinders can be connected to the hydraulic accumulator for the specific purpose of storing energy.

The invention is characterised in that a large part of the externally impressed or applied force during the lowering process is taken up by the differential cylinder that is connected to the hydraulic accumulator.

The invention is characterised in that the energy stored while retracting the hydraulic linear drive or cylinder can be directly released by exactly one or at least one of the hydraulic differential cylinders while extending the hydraulic linear drive. This can occur by appropriately connecting the single or multiple hydraulic accumulators to suitable valves. In doing so, it is advantageous that no intermediate conversion of the energy occur and no conversion losses arise.

The invention is characterised in that the energy stored while retracting the hydraulic linear drive can be transferred directly back into the drivetrain of the machine. This is achieved by connecting a hydraulic motor to the relevant hydraulic accumulator so that the energy contained in the hydraulic accumulator can be transferred to the drivetrain of the machine to assist the primary drive source, for example a diesel motor or electric motor.

The invention is further characterised in that the stored energy can be directly reused by transferring it into the linear drive and/or utilising it via the hydraulic motor. This method of reuse can be used either individually or serially.

The invention is further characterised in that the hydraulic linear drive can be retracted and extended without the single or multiple hydraulic accumulators and hydraulic valves for storing potential energy being activated. This is achieved within the hydraulic circuit by suitable parallel connection of the hydraulic linear drive.

The invention is further characterised in that the energy storage and release by means of the hydraulic linear drive is possible over the entire, or only a part of the full travel distance.

The invention is also characterised in that it can be integrated into the drivetrain of a machine without affecting the functioning of the drivetrain in such a way that it depends on the invention to function fully. This means that the machine can be operated flawlessly even without the functionality of the invention.

The invention claimed is:

1. A device for recovering hydraulic energy in a machine comprising:

a first differential cylinder-piston assembly having a differential cylinder with a separate rod side and a base side, the base side of the first differential cylinder-piston assembly coupled to a first brake valve, wherein a shut-off valve is positioned between the base side of the first differential cylinder-piston assembly and the first brake valve;

a second differential cylinder-piston assembly having a differential cylinder with a separate rod side and a base side, the base side of the second differential cylinder-piston assembly coupled to a second brake valve, where the second brake valve is different than the first brake valve; and one hydraulic accumulator that is hydraulically connected to at least one of the first and second differential cylinder-piston assemblies;

wherein the first and second differential cylinder-piston assemblies are mechanically coupled to one another;

wherein a potential energy of at least one of the first and second differential cylinder-piston assemblies is at least partially stored in the hydraulic accumulator; and wherein at least one of the first and second differential cylinder-piston assemblies retracts under a compressive load, wherein the potential energy of only the first differential cylinder-piston assembly is stored in the hydraulic accumulator.

2. The device according to claim 1, wherein the hydraulic accumulator is hydraulically connected to the first and second differential cylinder-piston assemblies.

3. The device according to claim 1, wherein the device further comprises an assisting motor that directs the hydraulic energy stored in the hydraulic accumulator into a drivetrain of the machine, wherein the assisting motor is hydraulically connected to the hydraulic accumulator via an assisting motor valve.

4. The device according to claim 3, wherein the stored hydraulic energy is transferred simultaneously, alternately, or sequentially to at least one of the drivetrain and at least one of the first and second differential cylinder-piston assemblies.

5. The device according to claim 1, wherein the device recovers the hydraulic energy stored in the hydraulic accumulator by transferring the hydraulic energy to at least one of the first and second differential cylinder-piston assemblies.

6. The device according to claim 5, wherein the stored hydraulic energy is transferred simultaneously, alternately, or sequentially to at least one of a drivetrain and at least one of the first and second differential cylinder-piston assemblies.

7. The device according to claim 1, wherein the first and second differential cylinder-piston assemblies operate in parallel.

8. The device according to claim 1, further comprising an operating pump for driving the first and second differential cylinder-piston assemblies.

9. The device according to claim 8, wherein the shut-off valve isolates at least one of the first and second differential cylinder-piston assemblies from a tank and from the operating pump.

10. The device according to claim 8, wherein the device has the shut-off valve for isolating at least one of the first and second differential cylinder-piston assemblies from a tank and from the operating pump.

11. The device according to claim 1, wherein the machine is operable in an event of a breakdown of the device for recovering hydraulic energy.

12. The device according to claim 1, further comprising at least one operating pump for driving the first and second differential cylinder-piston assemblies and at least one slide valve for controlling the hydraulic accumulator.

13. The device according to claim 1, further comprising at least one slide valve for controlling the hydraulic accumulator and the first and second differential cylinder-piston assemblies.

14. The device according to claim 1, further comprising at least one tank.

15. The device according to claim 1, further comprising at least one hydraulic accumulator valve.

16. A device for recovering hydraulic energy in a machine comprising:

a first differential cylinder-piston assembly having a differential cylinder with a separate rod side and a base side, the base side of the first differential cylinder-piston assembly coupled to a first brake valve, wherein a shut-off valve is positioned between the base side of the first differential cylinder-piston assembly and the first brake valve;

a second differential cylinder-piston assembly having a differential cylinder with a separate rod side and a base side, the base side of the second differential cylinder-piston assembly coupled to a second brake valve, where the second brake valve is different than the first brake valve;

one hydraulic accumulator that is hydraulically connected to at least one of the first and second differential cylinder-piston assemblies; and an operating pump for driving the first and second differential cylinder-piston assemblies;

wherein the first and second differential cylinder-piston assemblies are mechanically coupled to one another;

wherein a potential energy of at least one of the first and second differential cylinder-piston assemblies is at least partially stored in the hydraulic accumulator; and wherein at least one of the first and second differential cylinder-piston assemblies retracts under a compressive load; and wherein the shut-off valve isolates at least one of the first and second differential cylinder-piston assemblies from a tank and from the operating pump.

* * * * *